US008729462B2

(12) United States Patent
Gilbert et al.

(10) Patent No.: US 8,729,462 B2
(45) Date of Patent: May 20, 2014

(54) TIME OF FLIGHT ACQUISITION SYSTEM

(75) Inventors: Anthony James Gilbert, High Peak (GB); Garry M. Scott, Lancashire (GB)

(73) Assignee: Micromass UK Limited, Wilmslow (GB)

( * ) Notice: Subject to any disclaimer, the term of this patent is extended or adjusted under 35 U.S.C. 154(b) by 24 days.

(21) Appl. No.: 13/319,791

(22) PCT Filed: May 13, 2010

(86) PCT No.: PCT/GB2010/000962
§ 371 (c)(1),
(2), (4) Date: Dec. 9, 2011

(87) PCT Pub. No.: WO2010/131002
PCT Pub. Date: Nov. 18, 2010

(65) Prior Publication Data

US 2012/0085901 A1 Apr. 12, 2012

Related U.S. Application Data

(60) Provisional application No. 61/220,621, filed on Jun. 26, 2009.

(30) Foreign Application Priority Data

May 13, 2009 (GB) ..... 0908210.8

(51) Int. Cl.

| | |
|---|---|
| ***H01J 49/40*** | (2006.01) |
| ***H01J 49/04*** | (2006.01) |
| ***H01J 49/00*** | (2006.01) |

(52) U.S. Cl.
CPC ..... *H01J 49/40* (2013.01); *H01J 49/0036* (2013.01)
USPC ..... 250/287; 250/282

(58) Field of Classification Search
USPC ..... 250/287, 282; 368/113
See application file for complete search history.

(56) References Cited

U.S. PATENT DOCUMENTS 3,340,395 A 9/1967 Webb (Continued)

FOREIGN PATENT DOCUMENTS

| | | |
|---|---|---|
| JP | 2003348667 | 12/2000 |
| JP | 2001351570 | 12/2001 |
| JP | 2008249694 | 10/2008 |
| WO | 0217349 | 2/2002 |

OTHER PUBLICATIONS

PCT Written Opinion for the International Searching Authority for Application No. PCT/GB2010/000962, Form PCT/ISA/237, dated Jul. 26, 2010.

(Continued)

*Primary Examiner* — Jack Berman
*Assistant Examiner* — Wyatt Stoffa
(74) *Attorney, Agent, or Firm* — Diederiks & Whitelaw, PLC

(57) ABSTRACT

A Time of Flight Acquisition system is disclosed wherein a digitiser (6) is used to digitise an acceleration pulse (2) which is applied to an acceleration electrode of a Time of Flight mass analyzer. The digitiser (6) is then switched to digitise an ion arrival signal which is output from an ion detector (5).

15 Claims, 4 Drawing Sheets

(56) References Cited

U.S. PATENT DOCUMENTS

| | | | | |
|---|---|---|---|---|
| 6,373,052 | B1 * | 4/2002 | Hoyes et al. | 250/287 |
| 6,785,194 | B1 * | 8/2004 | Peck et al. | 368/113 |
| 7,043,406 | B1 * | 5/2006 | Welkie et al. | 702/194 |
| 2006/0016977 | A1 * | 1/2006 | Kawato | 250/287 |
| 2008/0272290 | A1 | 11/2008 | Vestal | |
| 2008/0272293 | A1 | 11/2008 | Vestal | |
| 2009/0321628 | A1 * | 12/2009 | Bateman et al. | 250/282 |

OTHER PUBLICATIONS

PCT Searach Report for the International Searching Authority for Application No. PCT/GB2010/000962, Form PCT/ISA/210, dated Jul. 26, 2010.

The Comiinbed Search and Examination Report under Sections 17 & 18(3) for Application No. GB1008048.9, dated Sep. 14, 2010.

* cited by examiner

TIME OF FLIGHT ACQUISITION SYSTEM

CROSS REFERENCE TO RELATED APPLICATIONS

This application is the National Stage of International Application No. PCT/GB2010/000962 filed on May 13, 2010, which claims priority to and benefit of U.S. Provisional Patent Application Ser. No. 61/220,621 filed on Jun. 26, 2009, and United Kingdom Patent Application No. 0908210.8 filed on May 13, 2009. The entire contents of these applications are incorporated herein by reference.

BACKGROUND OF THE INVENTION

The present invention relates to a mass spectrometer and a method of mass spectrometry. According to the preferred embodiment a time of flight acquisition system is provided.

As will be understood by those skilled in the art, there is uncertainty in the recorded times of ions which are detected by a Time of Flight mass analyser due to sampling both of the accelerating pulse and of the detector signals. The resulting uncertainty amounts to the sampling interval and is due to asynchronicity of the sampling clock with the time of flight acquisition system.

For a single flight of ions the timing uncertainty results in an error in the recorded or determined mass or mass to charge ratio of the detected ion. Where many flights are integrated then the error decreases with the square root of the number of flights being integrated but the uncertainty nonetheless results in a broadening of the integrated detected signal and an apparent reduction in the system resolution.

It is known to attempt to initiate the accelerating pulse from the sampling clock. However, this approach suffers from the problem of introducing jitter in the accelerating event and this jitter is equivalent to timing uncertainty. The known approach does not remove the asynchronicity of the detected signal because the time of arrival is highly unlikely to be an exact integral multiple of the sampling time. As a result, the known arrangement suffers from the problem of systematic timing errors which does not reduce as more flights are integrated.

It is therefore desired to provide a method of mass spectrometry and a mass spectrometer which does not suffer from the above mentioned problems.

SUMMARY OF THE INVENTION

According an aspect of the present invention there is provided a method of mass spectrometry comprising:

applying an accelerating pulse to an acceleration electrode in order to accelerate ions into a field free or drift region of a mass analyser;

detecting at least some of the ions after the ions have passed through the field free or drift region using an ion detector; and digitising an ion arrival signal which is output by the ion detector in order to determine an ion arrival time;

wherein the method further comprises:

digitising the accelerating pulse in order to determine an ion acceleration time.

The accelerating pulse is preferably acquired or digitised by a first Analogue to Digital Converter with reference to a first sampling clock and the ion arrival signal is also preferably acquired or digitised by the same first Analogue to Digital Converter with reference to the first sampling clock.

In a mode of operation the first Analogue to Digital Converter is set initially to acquire or digitise the accelerating pulse and is then switched subsequently to acquire or digitise the ion arrival signal.

According to a less preferred embodiment the accelerating pulse may be acquired or digitised by a first Analogue to Digital Converter with reference to a first sampling clock and the ion arrival signal may then subsequently be acquired or digitised by a second different Analogue to Digital Converter. The second Analogue to Digital Converter is preferably synchronised with the first Analogue to Digital Converter.

A mass or mass to charge ratio of an ion is preferably determined based upon the difference between the determined ion arrival time and the determined ion acceleration time.

According to the preferred embodiment ions are orthogonally accelerated into the field free or drift region.

The step of digitising the accelerating pulse preferably further comprises determining a time corresponding to x % of the pulse height of the accelerating pulse, wherein x is selected from the group consisting of: (i) <10; (ii) 10-20; (iii) 20-30; (iv) 30-40; (v) 40-50; (vi) 50-60; (vii) 60-70; (viii) 70-80; (ix) 80-90; and (x) >90.

According to the preferred embodiment the step of determining an ion arrival time further comprises determining a centroid of an ion arrival peak.

According to another aspect of the present invention there is provided a mass spectrometer comprising:

an acceleration electrode to which an accelerating pulse is applied, in use, in order to accelerate ions into a field free or drift region of a mass analyser;

an ion detector arranged and adapted to detect at least some of the ions after the ions have passed through the field free or drift region; and a digitiser arranged and adapted to digitise an ion arrival signal which is output by the ion detector in order to determine an ion arrival time;

wherein:

a digitiser is arranged and adapted to digitise the accelerating pulse in order to determine an ion acceleration time.

The digitiser preferably comprises a first Analogue to Digital Converter which is preferably arranged and adapted to acquire or digitise the accelerating pulse with reference to a first sampling clock and wherein the ion arrival signal is also acquired or digitised by the same first Analogue to Digital Converter with reference to the first sampling clock.

The mass spectrometer preferably further comprises a switch wherein in a mode of operation the switch is arranged so that the first Analogue to Digital Converter is set initially to acquire or digitise the accelerating pulse and wherein the switch is then set so that the first Analogue to Digital Converter subsequently acquires or digitises the ion arrival signal.

According to a less preferred embodiment the mass spectrometer may comprise a first Analogue to Digital Converter and a second different Analogue to Digital Converter. According to this embodiment the accelerating pulse is acquired or digitised by the first Analogue to Digital Converter with reference to a first sampling clock and the ion arrival signal is then acquired or digitised by the second Analogue to Digital Converter. The second Analogue to Digital Converter is preferably arranged and adapted to be synchronised, in use, with the first Analogue to Digital Converter.

According to the preferred embodiment the mass spectrometer preferably comprises an orthogonal acceleration Time of Flight mass analyser.

According to the preferred embodiment the profile of an accelerating pulse is preferably acquired using the same Analogue to Digital Converter ("ADC") and sampling clock which is preferably also used to acquire or digitise the detector signal which is output by the ion detector. A digitiser is preferably switched between the detector output and the accelerating pulse so that the accelerating pulse is preferably initially sampled at the start of a flight of ions into the drift or field free region of a mass analyser and the detector output is preferably sampled thereafter. The accelerating pulse profile is preferably examined, in real time, to determine the time position of a significant point on it. According to an embodiment the significant point may be taken to be the 50% point of the leading edge. The position is preferably recorded with a precision greater than that of the sampling clock. The precise time at which ions are deemed to be accelerated into the drift or field free region of the mass analyser is preferably subtracted from subsequently recorded ion arrival times which are also preferably recorded with a precision greater than that of the sampling clock.

The first Analogue to Digital Converter and/or the second Analogue to Digital Converter are preferably arranged to convert an analogue voltage to a digital output. The first Analogue to Digital Converter and/or the second Analogue to Digital Converter are preferably: (a) arranged to operate, in use, at a digitisation rate selected from the group consisting of: (i) <1 GHz; (ii) 1-2 GHz; (iii) 2-3 GHz; (iv) 3-4 GHz; (v) 4-5 GHz; (vi) 5-6 GHz; (vii) 6-7 GHz; (viii) 7-8 GHz; (ix) 8-9 GHz; (x) 9-10 GHz; and (xi) >10 GHz; and/or (b) comprise a resolution selected from the group consisting of: (i) at least 4 bits; (ii) at least 5 bits; (iii) at least 6 bits; (iv) at least 7 bits; (v) at least 8 bits; (vi) at least 9 bits; (vii) at least 10 bits; (viii) at least 11 bits; (ix) at least 12 bits; (x) at least 13 bits; (xi) at least 14 bits; (xii) at least 15 bits; and (xiii) at least 16 bits.

The mass spectrometer preferably further comprises:

(a) an ion source arranged upstream of the ion detector, wherein the ion source is selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a. Nickel-63 radioactive ion source; (xvii) an Atmospheric Pressure Matrix Assisted Laser Desorption Ionisation ion source; and (xviii) a Thermospray ion source; and/or (b) one or more ion guides arranged upstream of the ion detector; and/or (c) one or more ion mobility separation devices and/or one or more Field Asymmetric Ion Mobility Spectrometer devices arranged upstream of the ion detector; and/or (d) one or more ion traps or one or more ion trapping regions arranged upstream of the ion detector; and/or (e) a collision, fragmentation or reaction cell arranged upstream of the ion detector, wherein the collision, fragmentation or reaction cell is selected from the group consisting of: (i) a Collisional Induced Dissociation ("CID") fragmentation device; (ii) a Surface Induced Dissociation ("SID") fragmentation device; (iii) an Electron Transfer Dissociation fragmentation device; (iv) an Electron Capture Dissociation fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (Xi) an in-source fragmentation device; (xii) an ion-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; and (xxviii) an ion-metastable atom reaction device for reacting ions to form adduct or product ions.

BRIEF DESCRIPTION OF THE DRAWINGS

Various embodiments of the present invention together with other arrangements given for illustrative purposes only will now be described, by way of example only, and with reference to the accompanying drawings in which.

DETAILED DESCRIPTION OF THE INVENTION

Figure 1:
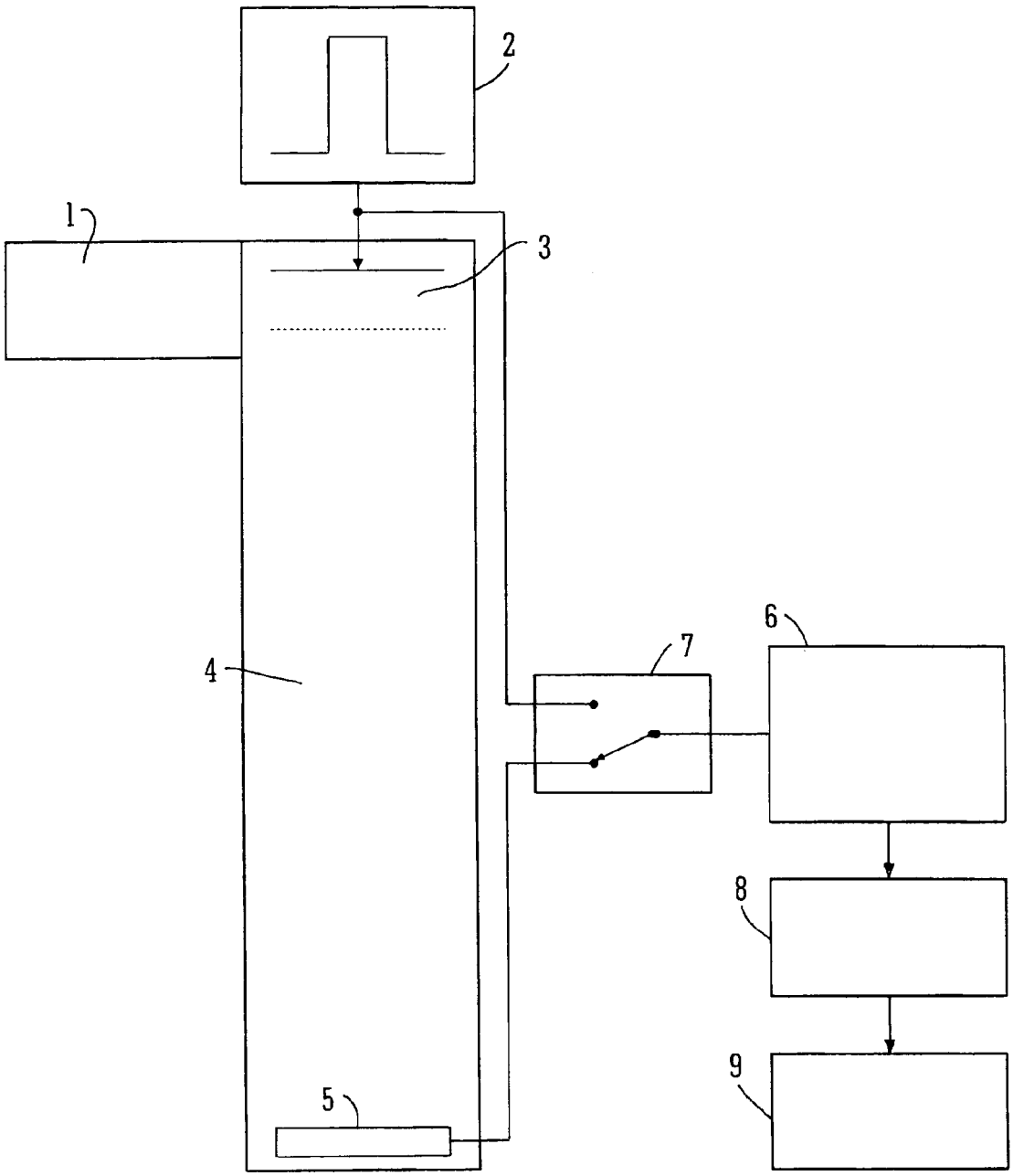
FIG. 1 shows a time of flight mass spectrometer according to an embodiment of the present invention.

A preferred embodiment of the present invention will now be described with reference to FIG. 1. FIG. 1 shows a Time of Flight mass spectrometer according to an embodiment of the present invention comprising an ion source 1, an acceleration pulse generator which is arranged to drive an acceleration region 3 by applying an orthogonal acceleration pulse 2 to an orthogonal acceleration electrode disposed adjacent a field free or drift region 4 of a mass analyser. An ion detector 5 is preferably arranged at the exit region of the field free or drift region 4 of the mass analyser.

A digitiser 6, whose input is preferably connected by a switch 7 to either the detector output or the acceleration pulse is also preferably provided. The detector output or digitiser output is preferably processed by a processor 8 and is preferably stored in a memory 9.

Ions formed in the ion source 1 are preferably arranged to enter the orthogonal acceleration region 3 where they are driven by the acceleration pulse 2 into the field free or drift region 4. The ions are then preferably accelerated to a velocity determined by the energy imparted by the acceleration pulse 2 and the mass or mass to charge ratio of the ions. Ions having a relatively low mass to charge ratio achieve a relatively high velocity and reach the ion detector 5 prior to ions having a relatively high mass to charge ratio.

Ions arrive at the ion detector 5 after a time determined by their velocity and the distance travelled which enables the mass or mass to charge ratio of the ions to be determined.

There is a period of time from the start of an accelerating pulse 2 before ions having a relatively low mass to charge ratio will actually arrive at the ion detector 5. According to the preferred embodiment this time is used to digitise the acceleration pulse 2 in order to determine accurately a point on its edge with respect to the digitising clock. According to an embodiment the point on its leading edge which is determined may correspond with a point having an intensity of 50% of the difference between the pulse height and the baseline. This point may be deemed to correspond with the point in time when the acceleration pulse 2 is effectively applied to the orthogonal acceleration electrode and ions are accelerated into the field free or drift region 4. The digitisation of many points allows the position of the 50% height point to be determined with a precision greater than that of the sampling clock. The position, once determined, is then preferably stored in memory 9.

Immediately prior to generation of the acceleration pulse 2 the switch 7 is preferably positioned or switched so as to allow the digitiser 6 to sample the acceleration pulse 2. Once the digitiser 6 has sampled the acceleration pulse 2 then the switch 7 is then preferably positioned or switched so as to allow the digitiser 6 to sample the detector signal which is output from the ion detector 5.

Ions arriving at the ion detector 5 are preferably sampled and a value representative of their arrival time is preferably calculated by the processor 8. The digitisation of many points allows the value to be determined with a precision greater than that of the sampling clock. The position previously determined as corresponding to the initiation of the acceleration pulse 2 is preferably subtracted from the determined flight time and the resulting value is preferably stored in memory 9.

A spectrum is preferably formed by recording multiple instances of ion arrivals from multiple acceleration events.

Figure 2:
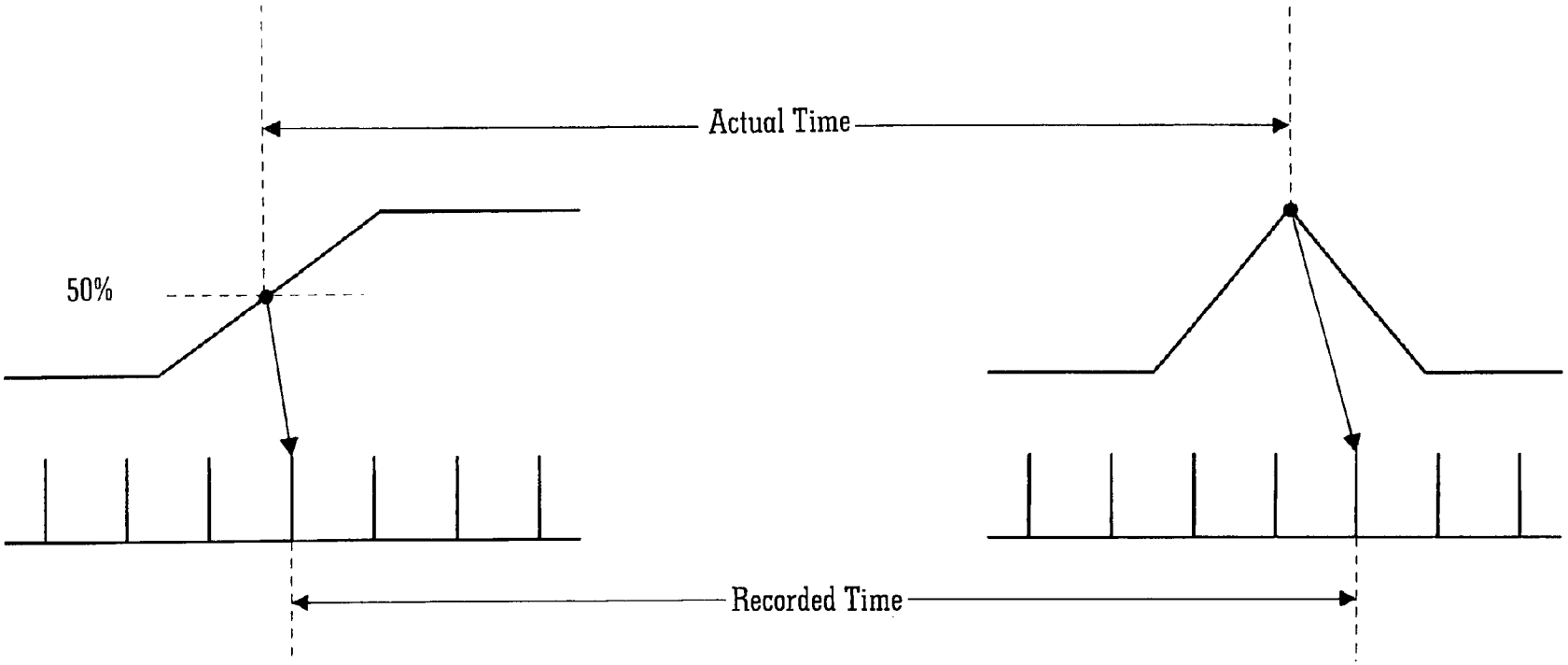
FIG. 2 PRIOR ART
FIG. 2 shows a known approach wherein acceleration events and flight times are recorded to the nearest clock sample.

FIG. 2 illustrates a known approach wherein both acceleration events and flight times are both recorded to the nearest clock sample.

Figure 3:
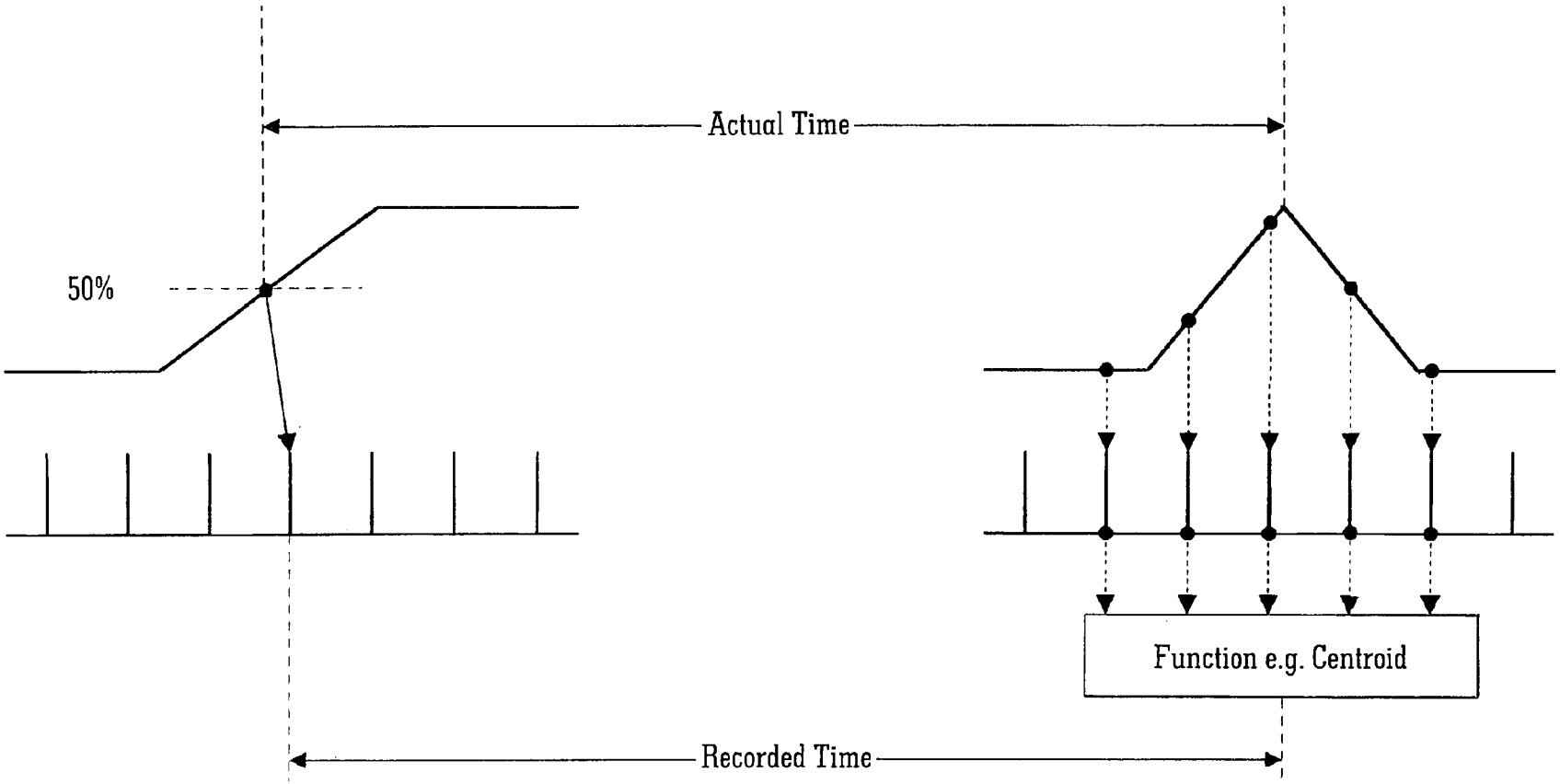
FIG. 3 PRIOR ART
FIG. 3 shows a known approach wherein acceleration events are recorded to the nearest clock sample and flight times are recorded with greater precision by determining the centroid of an ion peak.

FIG. 3 illustrates another known approach wherein acceleration events are recorded to the nearest clock sample but flight times are recorded with greater precision than the known approach illustrated in FIG. 2 by determining the centroid of the ion peak.

Figure 4:
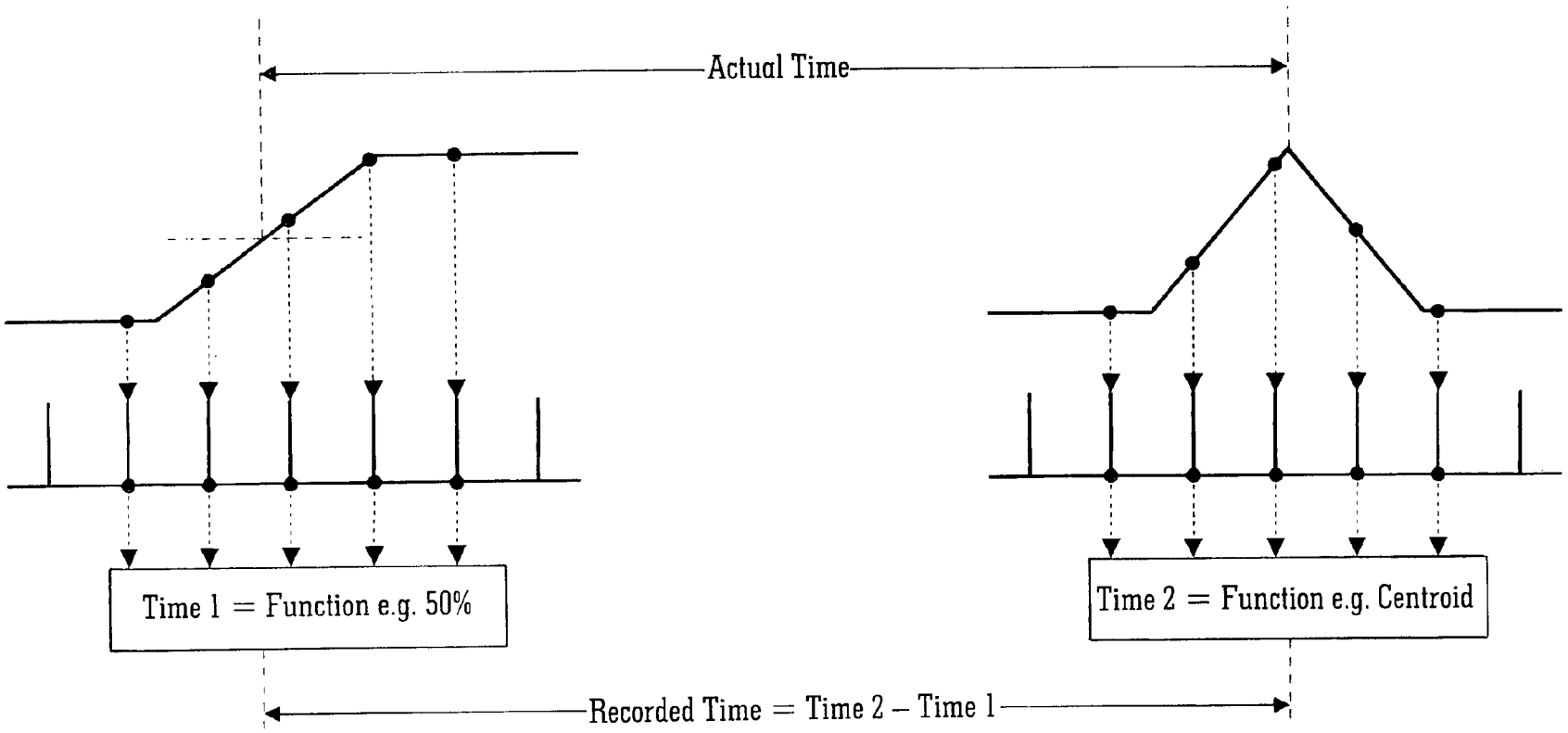
FIG. 4 shows a preferred embodiment of the present invention wherein both acceleration events and flight times are recorded with greater precision.

FIG. 4 illustrates a preferred embodiment of the present invention wherein both the acceleration event and the resulting ion flight time are recorded with greater precision than the known approach as illustrated in FIG. 2.

According to the preferred embodiment a determination is made of a first time (Time 1) corresponding to when the leading edge of the acceleration pulse 2 reaches 50% of the pulse height. The first time (Time 1) is taken to correspond with the time when ions are first orthogonally accelerated into the field free or drift region 4. A determination is also made of a second time (Time 2) which preferably corresponds with the centroid of the ion peak as output by the ion detector 5. The flight time of an ion is preferably determined by subtracting the first time (Time 1) from the second time (Time 2).

According to an alternative less preferred embodiment the switch 7 may be omitted, and a second, synchronised, ADC may be provided. One ADC may be arranged to sample the accelerating pulse 2 and the other ADC may be arranged to sample the ion peaks as output by the ion detector 5.

Although the present invention has been described with reference to preferred embodiments, it will be understood by those skilled in the art that various changes in form and detail may be made without departing from the scope of the invention as set forth in the accompanying claims.

The invention claimed is:

1. A method of mass spectrometry comprising:

applying an accelerating pulse to an acceleration electrode in order to accelerate ions into a field free or drift region of a mass analyser;

detecting at least some of said ions after said ions have passed through said field free or drift region using an ion detector;

digitising an ion arrival signal which is output by said ion detector in order to determine an ion arrival time; and digitising points of time associated with said accelerating pulse with reference to a digitising clock, each of the points of time corresponding to a pulse height, and determining a time between two consecutive ones of said points of time corresponding to a starting point of said acceleration pulse, and constituting an ion acceleration time.

2. A method as claimed in claim 1, wherein said accelerating pulse is acquired or digitised by a first Analogue to Digital Converter with reference to said digitising clock and wherein said ion arrival signal is also acquired or digitised by said same first Analogue to Digital Converter with reference to said digitising clock.

3. A method as claimed in claim 2, wherein in a mode of operation said first Analogue to Digital Converter is set initially to acquire or digitise said accelerating pulse and is then switched to acquire or digitise said ion arrival signal.

4. A method as claimed in claim 1, wherein said accelerating pulse is acquired or digitised by a first Analogue to Digital Converter with reference to said digitising clock and wherein said ion arrival signal is acquired or digitised by a second different Analogue to Digital Converter.

5. A method as claimed in claim 4, wherein said second Analogue to Digital Converter is synchronised with said first Analogue to Digital Converter.

6. A method as claimed in claim 1, wherein a mass or mass to charge ratio of an ion is determined based upon the difference between said determined ion arrival time and said determined ion acceleration time.

7. A method as claimed in claim 1, wherein said ions are orthogonally accelerated into said field free or drift region.

8. A method as claimed in claim 1, wherein said determining a time comprises determining a time corresponding to x % of a maximum pulse height of said accelerating pulse, wherein x is selected from the group consisting of: (i) 10-20; (ii) 20-30; (iii) 30-40; (iv) 40-50; (v) 50-60; (vi) 60-70; (vii) 70-80; (viii) 80-90.

9. A method as claimed in claim 1, wherein said step of determining an ion arrival time further comprises determining a centroid of an ion arrival peak.

10. A mass spectrometer comprising:

an acceleration electrode to which an accelerating pulse is applied, in use, in order to accelerate ions into a field free or drift region of a mass analyser;

an ion detector arranged and adapted to detect at least some of said ions after said ions have passed through said field free or drift region;

a digitiser arranged and adapted to digitise an ion arrival signal which is output by said ion detector in order to determine an ion arrival time;

wherein a digitiser is arranged and adapted to digitise points of time associated with said accelerating pulse with reference to a digitising clock, each of the points of time including a pulse height, and said mass spectrometer is arranged and adapted to determine a time, between two consecutive ones of said points of time, corresponding to a starting point of said accelerating pulse, the starting point and constituting an ion acceleration time.

11. A mass spectrometer as claimed in claim 10, wherein said digitiser comprises a first Analogue to Digital Converter which is arranged and adapted to acquire or digitise said accelerating pulse with reference to said digitising clock and wherein said ion arrival signal is also acquired or digitised by said same first Analogue to Digital Converter with reference to said digitising clock.

12. A mass spectrometer as claimed in claim 11, further comprising a switch wherein in a mode of operation said switch is arranged so that said first Analogue to Digital Converter is set initially to acquire or digitise said accelerating pulse and wherein said switch is then set so that said first Analogue to Digital Converter subsequently acquires or digitises said ion arrival signal.

13. A mass spectrometer as claimed in claim 10, wherein said mass spectrometer comprises a first Analogue to Digital Converter and a second different Analogue to Digital Converter and wherein said accelerating pulse is acquired or digitised by said first Analogue to Digital Converter with reference to said digitising clock and wherein said ion arrival signal is acquired or digitised by said second Analogue to Digital Converter.

14. A mass spectrometer as claimed in claim 13, wherein said second Analogue to Digital Converter is arranged and adapted to be synchronised, in use, with said first Analogue to Digital Converter.

15. A mass spectrometer as claimed claim 10, wherein said mass spectrometer comprises an orthogonal acceleration Time of Flight mass analyser.

* * * * *